US006007611A

United States Patent [19]

Mheidle et al.

[11] Patent Number: 6,007,611

[45] Date of Patent: Dec. 28, 1999

[54] PROCESS FOR PRINTING TEXTILE FIBRE MATERIALS IN ACCORDANCE WITH THE INK-JET PRINTING PROCESS

[75] Inventors: Mickael Mheidle, Sausheim; Roger Lacroix, Village-Neuf, both of France; Peter Scheibli, Bottmingen, Switzerland

[73] Assignee: Ciba Specialty Chemicals Corporation, Tarrytown, N.Y.

[21] Appl. No.: 09/089,145

[22] Filed: Jun. 2, 1998

[30] Foreign Application Priority Data

Jun. 17, 1997 [SE] Sweden ..... 1474/97

[51] Int. Cl.[6] ..... C09D 11/02

[52] U.S. Cl. ..... 106/31.47; 106/31.48; 106/31.49; 106/31.36; 106/31.37; 106/31.58

[58] Field of Search ..... 106/31.48, 31.47, 106/31.49, 31.37, 31.36, 31.58

[56] References Cited

U.S. PATENT DOCUMENTS 5,250,121 10/1993 Yamamoto et al. ..... 106/31.47

5,584,918 12/1996 Suzuki et al. ..... 106/31.47

FOREIGN PATENT DOCUMENTS 0534428 3/1993 European Pat. Off. .

OTHER PUBLICATIONS

Structural formula of Reactive Blue 49 from Chemical Abstracts registery file on STN, no date available.
Derwent Abstract 85–273488/44, Sep. 1985.
Derwent Abstract 86–249864/38, Sep. 1986.

*Primary Examiner*—Helene Klemanski
*Attorney, Agent, or Firm*—Kevin T. Mansfield

[57] ABSTRACT

A process for printing textile fiber materials in accordance with the inkjet printing process, wherein the fiber materials are printed with an aqueous ink, comprising a) at least one reactive dye of formulae (1a) to (1j) as indicated herein, and b) 1,2-propylene glycol, N-methyl-2-pyrrolidone, an alginate or a water-soluble, non-ionic cellulose ether. The process is especially suitable for printing cellulosic fiber materials. The prints obtained have good fastness properties while having a high color yield.

14 Claims, No Drawings

PROCESS FOR PRINTING TEXTILE FIBRE MATERIALS IN ACCORDANCE WITH THE INK-JET PRINTING PROCESS

The present invention relates to a process for printing textile fibre materials using reactive dyes in accordance with the ink-jet printing process (for jet and ink-jet processes) and to corresponding printing inks.

Ink-jet printing processes have been used in the textile industry for some years. Such processes make it possible to dispense with the otherwise customary production of a printing screen, so that considerable savings can be made in terms of cost and time. Especially in the case of the production of pattern originals it is possible to respond to a change in requirements within a significantly shorter period of time.

Such ink-jet printing processes should especially have optimum characteristics from the standpoint of application technology. In this connection mention may be made of characteristics such as the viscosity, stability, surface-tension and conductivity of the inks used. Furthermore, higher demands are being made of the quality of the resulting prints, e.g. in respect of colour strength, fibre-dye bond stability and fastness to wetting. Those demands are not met by the known processes in all characteristics, so that there is still a need for new processes for the ink-jet printing of textiles.

The invention relates to a process for printing textile fibre materials in accordance with the ink-jet printing process, wherein the fibre materials are printed with an aqueous ink comprising a) at least one reactive dye of formulae (1a)

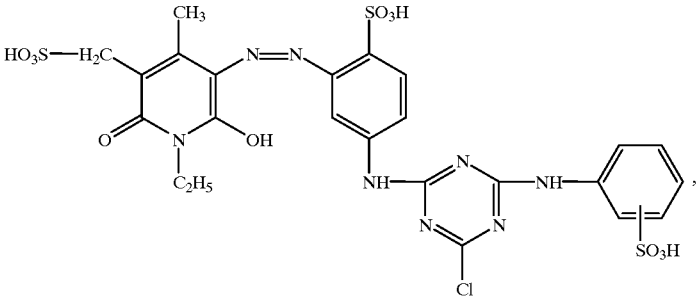

(1b)

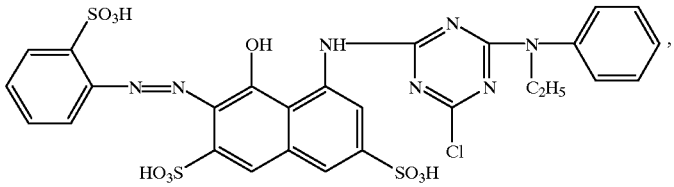

(1c)

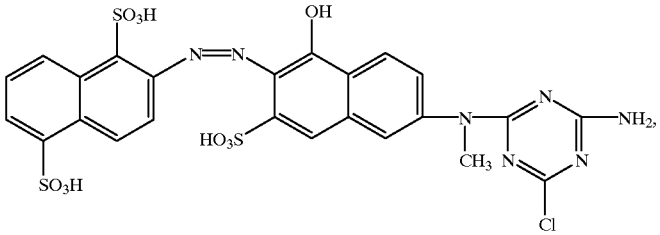

(1d)

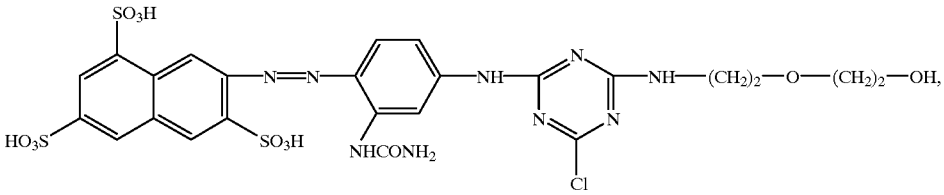

-continued
(1e)
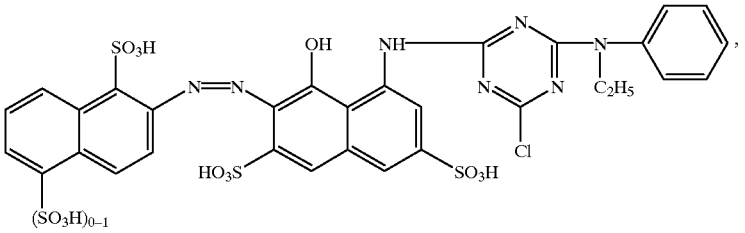
(1f)
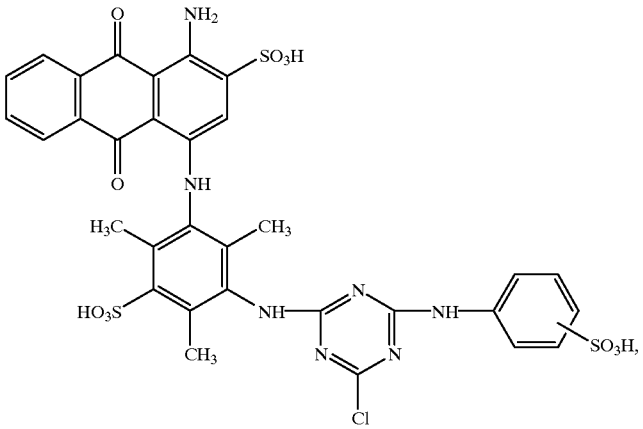
(1g)
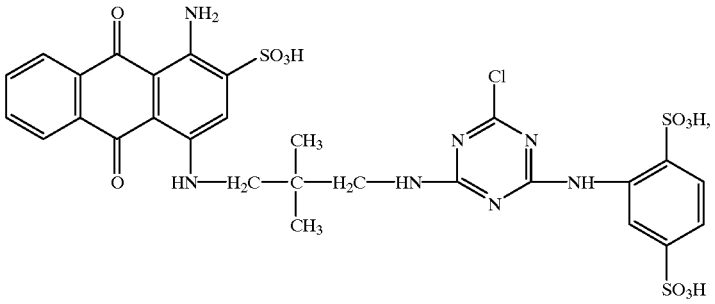
(1h)
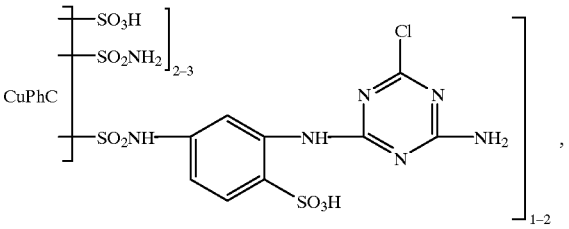
(1i)
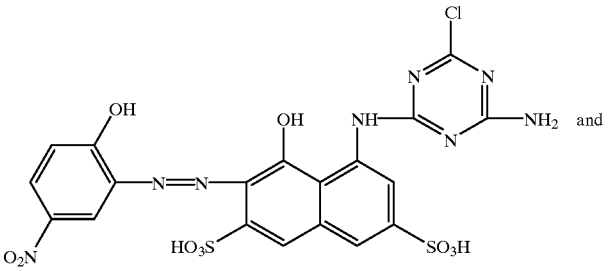
and
1:2 Cr complex -continued (1j)

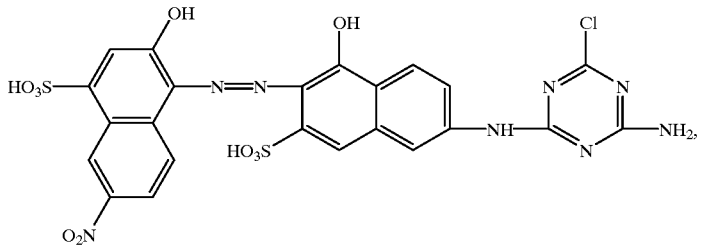

1:2 Co complex wherein CuPhC is a copper phthalocyanine radical, and b) 1,2-propylene glycol, N-methyl-2-pyrrolidone, an alginate or a water-soluble, non-ionic cellulose ether, with the proviso that when the ink used comprises a reactive dye of formula (1a), that dye is present in the ink together with N-methyl-2-pyrrolidone, an alginate or a water-soluble, non-ionic cellulose ether.

Preference is given to the use of an ink comprising at least one reactive dye of formulae (1a) to (1h), especially of formulae (1a) to (1g). Special preference is given to the use of an ink comprising at least one reactive dye of formulae (1b) to (1j), especially of formulae (1b) to (1h) and more especially of formulae (1b) to (1g).

In the reactive dyes of formula (1e) the sulfo group indicated as an alternative is preferably not present.

The reactive dye of formula (1j) is used preferably in admixture with a reactive dye of formula (1i).

The reactive dyes of formulae (1a) to (1j) are known or can be obtained analogously to known compounds, e.g. by customary diazotisation, coupling and condensation reactions.

The reactive dyes of formulae (1a) to (1j) used in the inks should preferably have a low salt content, that is to say they should have a total content of salts of less than 0.5% by weight, based on the weight of the dyes. Reactive dyes that have relatively high salt contents as a result of their preparation and/or as a result of the subsequent addition of diluents can be desalted, for example, by membrane separation procedures, such as ultrafiltration, reverse osmosis or dialysis.

The inks preferably comprise as dyes exclusively those of the above formulae (1a) to (1j).

The inks preferably have a total content of reactive dyes of the above formulae (1a) to (1j) of from 5 to 35% by weight, especially from 10 to 35% by weight and more especially from 10 to 20% by weight, based on the total weight of the ink.

The content of N-methyl-2-pyrrolidone or 1,2-propylene glycol in the ink is usually from 5 to 30% by weight, especially from 5 to 20% by weight and more especially from 10 to 20% by weight, based on the total weight of the ink.

Preferably, the inks comprise 1,2-propylene glycol, usually in an amount of from 5 to 30% by weight, especially from 5 to 20% by weight and more especially from 10 to 20% by weight, based on the total weight of the ink.

In accordance with another preferred embodiment, the inks comprise N-methyl-2-pyrrolidone, usually in an amount of from 5 to 30% by weight, especially from 5 to 20% by weight and more especially from 10 to 20% by weight, based on the total weight of the ink.

Suitable water-soluble, non-ionic cellulose ethers include, for example, methyl-, ethyl-, hydroxyethyl-, methylhydroxyethyl-, hydroxypropyl- and hydroxypropylmethyl-cellulose. Methylcellulose and especially hydroxyethylcellulose are preferred. Suitable alginates are especially alkali alginates and preferably sodium alginate. The cellulose ethers and the alginates are used in the ink usually in an amount of from 0.01 to 2% by weight, especially from 0.01 to 1% by weight and more especially from 0.01 to 0.5% by weight, based on the total weight of the ink. Both the water-soluble, non-ionic cellulose ethers and the alginates are used as so-called thickeners and enable an ink of a specific viscosity to be obtained.

In a preferred embodiment of the present invention the inks comprise an alginate, usually in an amount of from 0.01 to 2% by weight, especially from 0.01 to 1% by weight and more especially from 0.01 to 0.5% by weight, based on the total weight of the ink.

In accordance with another preferred embodiment, the inks comprise a water-soluble, non-ionic cellulose ether, usually in an amount of from 0.01 to 2% by weight, especially from 0.01 to 1% by weight and more especially from 0.01 to 0.5% by weight, based on the total weight of the ink.

Of special interest for the process according to the invention are inks comprising 1,2-propylene glycol or N-methyl-2-pyrrolidone together with an alginate or a water-soluble, non-ionic cellulose ether. The amounts to be used are, for example, in each case those mentioned above.

The inks may also comprise buffer substances, e.g. borax, borates or citrates. Examples that may be mentioned include borax, sodium borate, sodium tetraborate and sodium citrate. They are used especially in amounts of from 0.1 to 3% by weight, preferably from 0.1 to 1% by weight, based on the total weight of the ink, in order to establish a pH value of, for example, from 4 to 9, especially from 5 to 8.5.

Preferred for the process according to the invention are those inks which have a viscosity of from 1 to 40 mPa·s, especially from 1 to 20 mPa·s and more especially from 1 to 10 mPa·s.

The inks may also comprise customary additives, such as antifoam agents or especially substances that inhibit the growth of fungi and/or bacteria. Such additives are usually used in amounts of from 0.01 to 1% by weight, based on the total weight of the ink.

Also of interest are inks that contain no thioglycol.

The inks can be prepared in customary manner by mixing the individual constituents in the desired amount of water.

The process for printing textile fibre materials according to the invention can be carried out using ink-jet printers that are known per se and are suitable for textile printing.

In ink-jet printing, individual drops of the ink are sprayed onto a substrate in a controlled manner from a nozzle. For this purpose, predominantly the continuous ink-jet method and the drop-on-demand method are used. In the continuous ink-jet method, the drops are produced continuously and any drops not required for the printing are conveyed to a collecting vessel and recycled. In the drop-on-demand method, however, drops are produced and printed as required; that is to say drops are produced only when required for the printing. The production of the drops can be effected, for example, by means of a piezo-inkjet head or by means of thermal energy (bubble jet). For the process according to the invention, printing in accordance with the continuous ink-jet method is preferred.

Textile fibre materials that come into consideration are especially hydroxy-group-containing fibre materials. Preference is given to cellulosic fibre materials that consist wholly or partly of cellulose. Examples are natural fibre materials, such as cotton, linen and hemp, and regenerated fibre materials, for example viscose and lyocell. Special preference is given to viscose and especially cotton. The said fibre materials are preferably in the form of sheet-form textile woven fabrics, knitted fabrics or webs.

According to a preferred embodiment of the present invention, prior to printing the fibre material is subjected to a pretreatment in which the fibre material to be printed is first treated with an aqueous alkaline liquor and the treated fibre material is optionally dried.

The aqueous alkaline liquor comprises at least one of the customary bases used for fixing the reactive dyes in conventional reactive printing processes. The base is used, for example, in an amount of from 10 to 100 g/l of liquor, preferably from 10 to 50 g/l of liquor. Suitable bases are, for example, sodium carbonate, sodium hydroxide, disodium phosphate, trisodium phosphate, sodium acetate, sodium propionate, sodium hydrogen carbonate, aqueous ammonia or sources of alkali, such as sodium chloroacetate or sodium formate. It is preferable to use sodium hydrogen carbonate, sodium carbonate or a mixture of water glass and sodium carbonate. The pH value of the alkaline liquor is generally from 7.5 to 13.5, preferably from 8.5 to 12.5. In addition to the bases, the aqueous alkaline liquor may also comprise further additives, e.g. hydrotropic agents. The hydrotropic agent preferably used is urea, which is used, for example, in an amount of from 25 to 200 g/l of liquor, preferably from 50 to 150 g/l of liquor.

Preferably the fibre material is dried after the above pretreatment.

After printing, the fibre material is advantageously dried, preferably at temperatures of up to 150° C., especially from 80 to 120° C., and then subjected to a heat treatment process in order to complete the print, that is to say to fix the dye.

The heat treatment can be carried out, for example, by means of a hot batch process, a thermosol process or, preferably, by means of a steaming process.

In the case of the steaming process the printed fibre material is subjected, for example, to treatment in a steamer with steam which is optionally superheated, advantageously at a temperature of from 95 to 180° C., more especially in saturated steam.

Subsequently the printed fibre material is generally washed off with water in customary manner in order to remove unfixed dye.

The present invention relates also to aqueous printing inks for the ink-jet printing process, comprising a) from 5 to 35% by weight of at least one reactive dye of the above formulae (1a) to (1j) and b) from 0.01 to 2% by weight of an alginate.

The present invention relates also to aqueous printing inks for the ink-jet printing process, comprising a) from 5 to 35% by weight of at least one reactive dye of the above formulae (1a) to (1j), b) from 0.01 to 2% by weight of an alginate or a water-soluble, non-ionic cellulose ether, and c) from 5 to 30% by weight of 1,2-propylene glycol or N-methyl-2-pyrrolidone.

The printing inks are subject to the preferences mentioned hereinabove.

The prints obtainable according to the processes of the invention have good allround properties; for example, they have a high degree of fibre-dye bond stability in both the acidic and the alkaline range, good fastness to light, good fastness to wetting, such as fastness to washing, to water, to seawater, to crossdyeing and to sweat, and good fastness to chlorine, fastness to rubbing, fastness to hot pressing and fastness to pleating, as well as sharp outlines and a high colour strength. The printing inks used are distinguished by good stability and good viscosity characteristics.

The following Examples serve to illustrate the invention. The temperatures are given in degrees Celsius, parts are parts by weight and percentages relate to percent by weight, unless otherwise indicated. Parts by weight relate to parts by volume in a ratio of kilograms to liters.

EXAMPLE 1 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing
15% by weight of the reactive dye of formula (101)

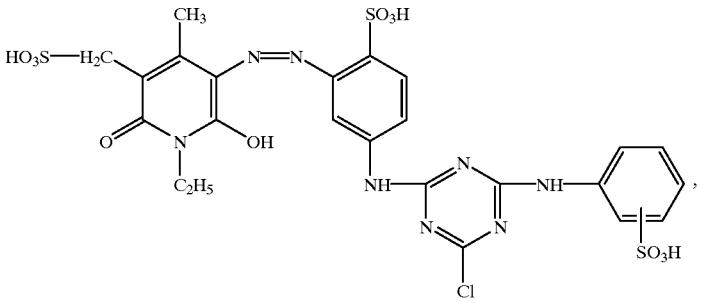

15% by weight of N-methyl-2-pyrrolidone and
70% by weight of water using a drop-on-demand ink-jet head (bubble jet). The print is dried completely and fixed for 8 minutes at 102° C. in saturated steam, cold-rinsed, washed off at boiling, rinsed again and dried. A yellow print having very good fastness to washing is obtained.

EXAMPLE 2 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (102)

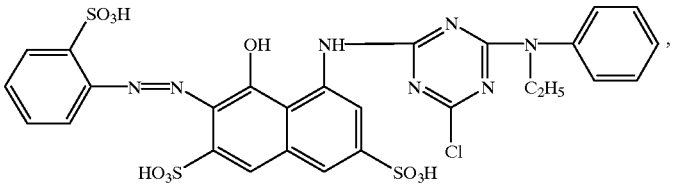

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A red print having very good fastness to washing is obtained.

EXAMPLE 3 a) Causticized woven viscose fabric is pad-dyed with a liquor comprising 30 g/l of sodium carbonate and 100 g/l of urea (liquor pick-up 70%) and dried.

b) The causticized woven viscose fabric pretreated in accordance with Step a) is printed with an aqueous ink containing
15% by weight of the reactive dye of formula (103)

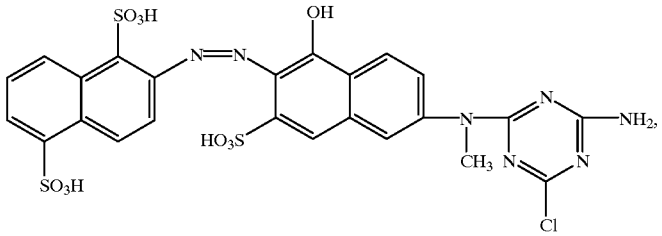

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. An orange print having very good fastness to washing is obtained.

EXAMPLE 4 a) Causticized woven viscose fabric is pad-dyed with a liquor comprising 30 g/l of sodium carbonate and 150 g/l of urea (liquor pick-up 70%) and dried.

b) The causticized woven viscose fabric pretreated in accordance with Step a) is printed with an aqueous ink containing 15% by weight of the reactive dye of formula

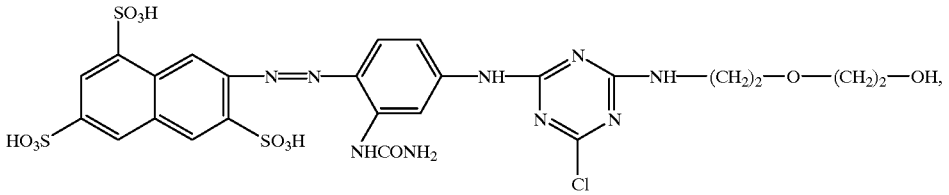

(104)

15% by weight of 1,2-propylene glycol and

70% by weight of water using a drop-on-demand ink-jet head (bubble jet). The print is dried completely and fixed for 8 minutes at 102° C. in saturated steam, cold-rinsed, washed off at boiling, rinsed again and dried. A yellow print having very good fastness to washing is obtained.

EXAMPLE 5 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing 15% by weight of the reactive dye of formula

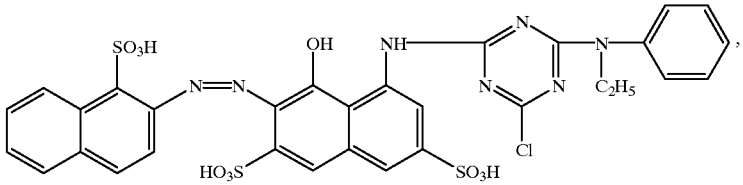

(105)

15% by weight of 1,2-propylene glycol and

70% by weight of water using a drop-on-demand ink-jet head (bubble jet). The print is dried completely and fixed for 8 minutes at 102° C. in saturated steam, cold-rinsed, washed off at boiling, rinsed again and dried. A red print having very good fastness to washing is obtained.

EXAMPLE 6 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing 15% by weight of the reactive dye of formula (106)

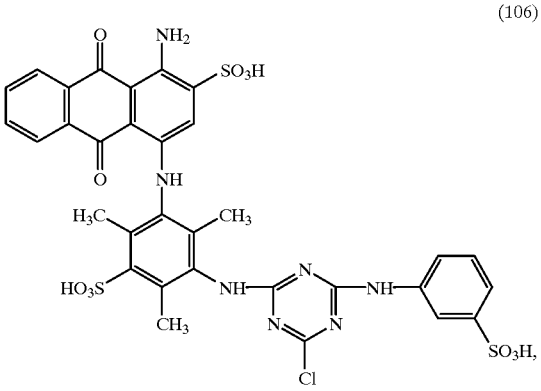

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A blue print having very good fastness to washing is obtained.

EXAMPLE 7 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (107)

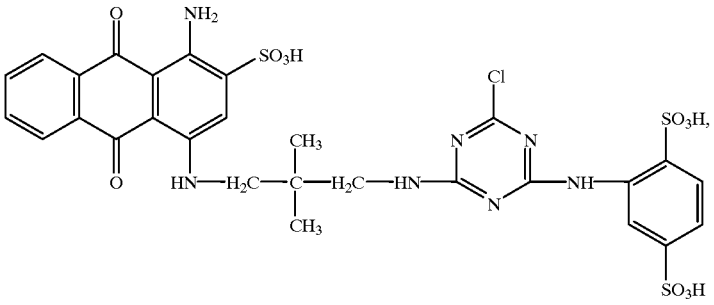

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A blue print having very good fastness to washing is obtained.

EXAMPLE 8 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (108)

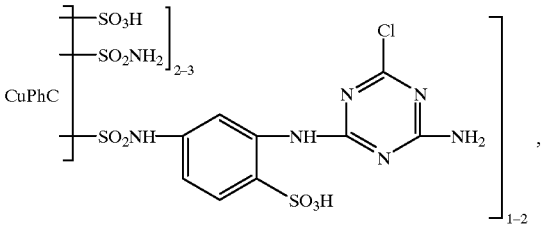

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A turquoise-coloured print having very good fastness to washing is obtained.

EXAMPLE 9 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing 15% by weight of the reactive dye of formula (109)

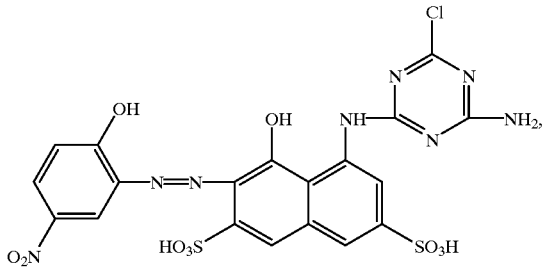

1:2 Cr complex

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A black print having very good fastness to washing is obtained.

EXAMPLE 10 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of a mixture in a ratio by weight of 1:1 of the reactive dye of formula (109) with the reactive dye of formula (110)

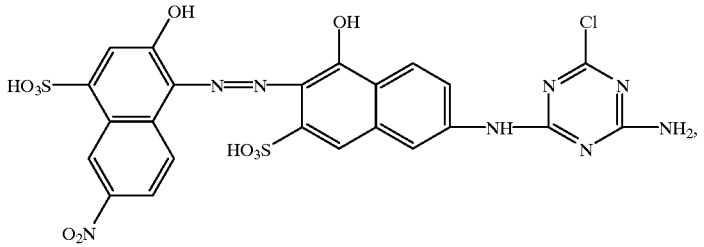

1:2 Co complex

15% by weight of 1,2-propylene glycol and
70% by weight of water using a drop-on-demand ink-jet head (bubble jet). The print is dried completely and fixed for 8 minutes at 102° C. in saturated steam, cold-rinsed, washed off at boiling, rinsed again and dried. A black print having very good fastness to washing is obtained.

EXAMPLES 11 TO 19

By following a procedure as indicated in any one of Examples 2 to 10 but using 15% by weight of N-methyl-2-pyrrolidone instead of 15% by weight of 1,2-propylene glycol, analogous prints having good fastness to washing are obtained.

EXAMPLE 20 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing
15% by weight of the reactive dye of formula (101),
15% by weight of 1,2-propylene glycol,
0.3% by weight of hydroxyethylcellulose and
69.7% by weight of water using a drop-on-demand piezo-inkjet head. The print is dried completely and fixed for 8 minutes at 102° C. in saturated steam, cold-rinsed, washed off at boiling, rinsed again and dried. A yellow print having very good fastness to washing is obtained.

EXAMPLE 21 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (102),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A red print having very good fastness to washing is obtained.

EXAMPLE 22 a) Causticized woven viscose fabric is pad-dyed with a liquor comprising 30 g/I of sodium carbonate and 100 g/l of urea (liquor pick-up 70%) and dried.

b) The causticized woven viscose fabric pretreated in accordance with Step a) is printed with an aqueous ink containing 15% by weight of the reactive dye of formula (103),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. An orange print having very good fastness to washing is obtained.

EXAMPLE 23 a) Causticized woven viscose fabric is pad-dyed with a liquor comprising 30 g/l of sodium carbonate und 150 g/l of urea (liquor pick-up 70%) and dried.

b) The causticized woven viscose fabric pretreated in accordance with Step a) is printed with an aqueous ink containing
15% by weight of the reactive dye of formula (104), 0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A yellow print having very good fastness to washing is obtained.

EXAMPLE 24 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing
15% by weight of the reactive dye of formula (105),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A red print having very good fastness to washing is obtained.

EXAMPLE 25 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (106),
0.3% by weight of hydroxyethylcellulose and
84.7% by weight of water using a continuous flow inkjet head. The print is dried completely and fixed for 8 minutes at 102° C. in saturated steam, cold-rinsed, washed off at boiling, rinsed again and dried. A blue print having very good fastness to washing is obtained.

EXAMPLE 26 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (107),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A blue print having very good fastness to washing is obtained.

EXAMPLE 27 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of the reactive dye of formula (108),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A turquoise-coloured print having very good fastness to washing is obtained.

EXAMPLE 28 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing
15% by weight of the reactive dye of formula (109),
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A black print having very good fastness to washing is obtained.

EXAMPLE 29 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing
15% by weight of a mixture of the reactive dyes of formulae (109) and (110) in a ratio by weight of 1:1,
0.3% by weight of hydroxyethylcellulose and
84.7% by weight of water using a continuous flow ink-jet head. The print is dried completely and fixed for 8 minutes at 102° C. in saturated steam, cold-rinsed, washed off at boiling, rinsed again and dried. A black print having very good fastness to washing is obtained.

EXAMPLES 30 TO 38

By following a procedure as indicated in any one of Examples 21 to 29 but using an ink that contains in addition 15% by weight of N-methyl-2-pyrrolidone and a correspondingly reduced amount of water instead of the amount of water indicated and carrying out the printing using a drop-on-demand piezo-inkjet head, analogous prints having good fastness to washing are obtained.

EXAMPLES 39 TO 47

By following a procedure as indicated in any one of Examples 21 to 29 but using an ink that contains in addition 15% by weight of 1,2-propylene glycol and a correspondingly reduced amount of water instead of the amount of water indicated and carrying out the printing using a drop-on-demand piezo-inkjet head, analogous prints having good fastness to washing are obtained.

EXAMPLES 48 TO 57

By following a procedure as indicated in Example 21 but using one of the inks from the following Table 1 instead of the ink indicated therein, there are likewise obtained prints having good fastness to washing.

TABLE 1

| Ex. | Composition of the ink |
|---|---|
| 48 | 10% by weight of the reactive dye of formula (101)<br>0.3% by weight of sodium alginate<br>89.7% by weight of water |
| 49 | 20% by weight of the reactive dye of formula (102)<br>0.3% by weight of sodium alginate<br>79.7% by weight of water |
| 50 | 15% by weight of the reactive dye of formula (103)<br>0.3% by weight of sodium alginate<br>84.7% by weight of water |
| 51 | 15% by weight of the reactive dye of formula (104)<br>0.3% by weight of sodium alginate<br>84.7% by weight of water |
| 52 | 15% by weight of the reactive dye of formula (105)<br>0.3% by weight of sodium alginate<br>84.7% by weight of water |
| 53 | 15% by weight of the reactive dye of formula (106)<br>0.3% by weight of sodium alginate<br>84.7% by weight of water |
| 54 | 15% by weight of the reactive dye of formula (107)<br>0.3% by weight of sodium alginate<br>84.7% by weight of water |
| 55 | 15% by weight of the reactive dye of formula (108)<br>0.3% by weight of sodium alginate<br>84.7% by weight of water |
| 56 | 15% by weight of the reactive dye of formula (109)<br>0.3% by weight of sodium alginate<br>84.7% by weight of water |
| 57 | 15% by weight of a mixture of the reactive dyes of formulae (109) and (110) in a ratio by weight of 1:1<br>0.3% by weight of sodium alginate<br>84.7% by weight of water |

EXAMPLES 58 TO 75

By following a procedure as indicated in Example 20 but using one of the inks from the following Table 2 instead of the ink indicated therein, there are likewise obtained prints having good fastness to washing.

TABLE 2

| Ex. | Composition of the ink |
|---|---|
| 58 | 15% by weight of the reactive dye of formula (102)<br>15% by weight of 1,2-propylene glycol<br>0.3% by weight of sodium alginate<br>69.7% by weight of water |
| 59 | 15% by weight of the reactive dye of formula (103)<br>15% by weight of 1,2-propylene glycol<br>0.3% by weight of sodium alginate<br>69.7% by weight of water |
| 60 | 15% by weight of the reactive dye of formula (104)<br>15% by weight of 1,2-propylene glycol<br>0.3% by weight of sodium alginate<br>69.7% by weight of water |
| 61 | 15% by weight of the reactive dye of formula (105)<br>15% by weight of 1,2-propylene glycol<br>0.3% by weight of sodium alginate<br>69.7% by weight of water |
| 62 | 15% by weight of the reactive dye of formula (106)<br>15% by weight of 1,2-propylene glycol<br>0.3% by weight of sodium alginate<br>69.7% by weight of water |
| 63 | 15% by weight of the reactive dye of formula (107)<br>15% by weight of 1,2-propylene glycol<br>0.3% by weight of sodium alginate<br>69.7% by weight of water |
| 64 | 15% by weight of the reactive dye of formula (108)<br>15% by weight of 1,2-propylene glycol<br>0.3% by weight of sodium alginate<br>69.7% by weight of water |
| 65 | 15% by weight of the reactive dye of formula (109)<br>15% by weight of 1,2-propylene glycol<br>0.3% by weight of sodium alginate<br>69.7% by weight of water |
| 66 | 15% by weight of a mixture of the reactive dyes of formulae (109) and (110) in a ratio by weight of 1:1<br>15% by weight of 1,2-propylene glycol<br>0.3% by weight of sodium alginate<br>69.7% by weight of water |
| 67 | 15% by weight of the reactive dye of formula (102)<br>15% by weight of N-methyl-2-pyrrolidone<br>0.3% by weight of sodium alginate<br>69.7% by weight of water |
| 68 | 15% by weight of the reactive dye of formula (103)<br>15% by weight of N-methyl-2-pyrrolidone<br>0.3% by weight of sodium alginate<br>69.7% by weight of water |
| 69 | 15% by weight of the reactive dye of formula (104)<br>15% by weight of N-methyl-2-pyrrolidone<br>0.3% by weight of sodium alginate<br>69.7% by weight of water |
| 70 | 15% by weight of the reactive dye of formula (105)<br>15% by weight of N-methyl-2-pyrrolidone<br>0.3% by weight of sodium alginate<br>69.7% by weight of water |
| 71 | 15% by weight of the reactive dye of formula (106)<br>15% by weight of N-methyl-2-pyrrolidone<br>0.3% by weight of sodium alginate<br>69.7% by weight of water |
| 72 | 15% by weight of the reactive dye of formula (107)<br>15% by weight of N-methyl-2-pyrrolidone<br>0.3% by weight of sodium alginate<br>69.7% by weight of water |
| 73 | 15% by weight of the reactive dye of formula (108)<br>15% by weight of N-methyl-2-pyrrolidone<br>0.3% by weight of sodium alginate<br>69.7% by weight of water |
| 74 | 15% by weight of the reactive dye of formula (109)<br>15% by weight of N-methyl-2-pyrrolidone<br>0.3% by weight of sodium alginate<br>69.7% by weight of water |
| 75 | 15% by weight of a mixture of the reactive dyes of formulae (109) and (110) in a ratio by weight of 1:1<br>15% by weight of N-methyl-2-pyrrolidone<br>0.3% by weight of sodium alginate<br>69.7% by weight of water |

EXAMPLES 76 TO 84

By following a procedure as indicated in any one of Examples 6 to 9 and 25 to 29 but using an ink that contains in addition 0.5% by weight of borax and a correspondingly reduced amount of water instead of the amount of water indicated, analogous prints having good fastness to washing are obtained.

EXAMPLES 85 TO 100

By following a procedure as indicated in any one of Examples 10, 53 to 57, 62 to 66 and 71 to 75 but using an ink that contains in addition 0.5% by weight of sodium citrate and a correspondingly reduced amount of water instead of the amount of water indicated, ana logous prints having good fastness to washing are obtained.

What is claimed is:

1. A process for printing textile fibre materials in accordance with the ink-jet printing process, wherein the fibre materials are printed with an aqueous ink comprising a) from 5 to 35% by weight of at least one reactive dye of the formulae (1a)
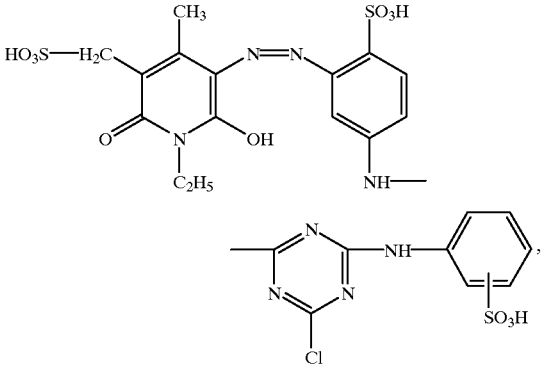
(1b)
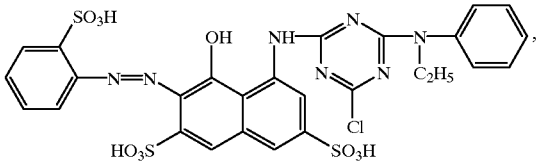
(1c)
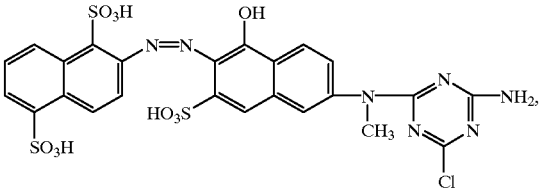
(1d)
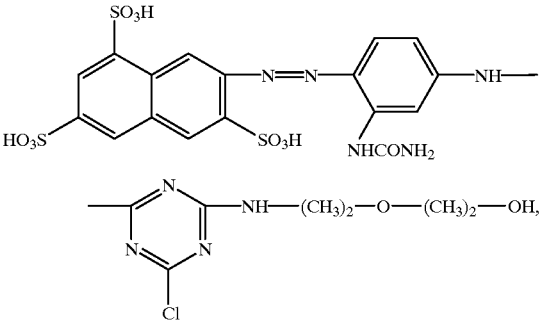
(1e)
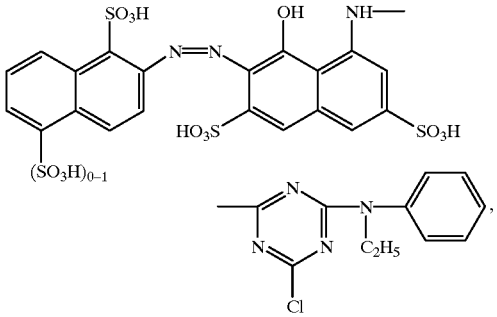
-continued
(1f)
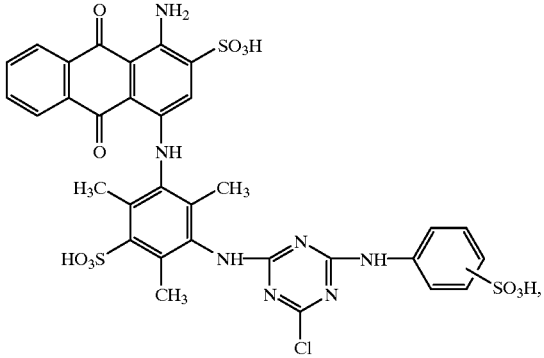
(1g)
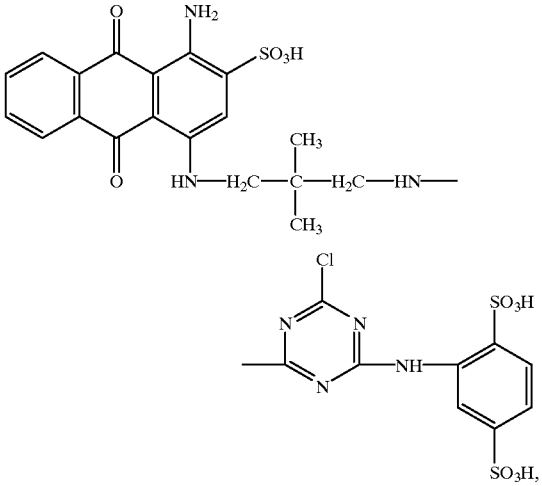
(1h)
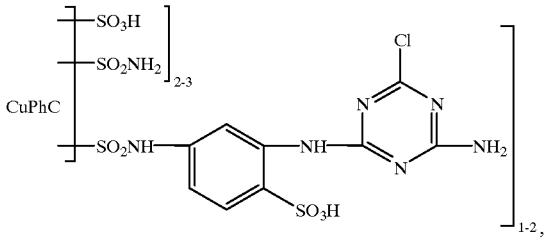
(1i)
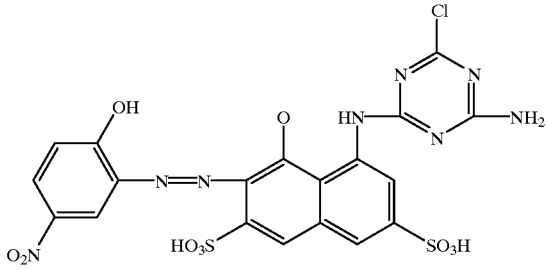
(1:2 Cr complex)
and -continued (1j)

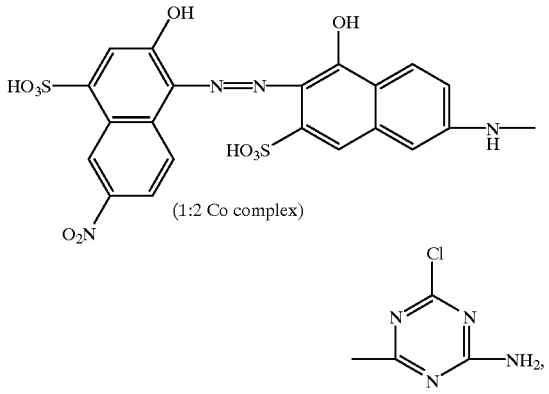

wherein CuPhC is a copper phthalocyanine radical, and b) 1,2-propylene glycol, N-methyl-2-pyrrolidone, an alginate or a water-soluble, non-ionic cellulose ether, with the proviso that said ink does not contain any substantial amount of a compound of the formula $S(CH_2CH_2OH)_2$.

2. A process according to claim 1, wherein said ink comprises at least one reactive dye of formulae (1a) to (1h).

3. A process according to claim 1, wherein said ink comprises at least one reactive dye of formulae (1a) to (1g).

4. A process according to claim 1, wherein said ink comprises at least one reactive dye of formulae (1b) to (1g).

5. A process according to claim 1, wherein said ink comprises from 5 to 30% by weight of 1,2-propylene glycol.

6. A process according to claim 1, wherein said ink comprises from 5 to 30% by weight of N-methyl-2-pyrrolidone.

7. A process according to claim 1, wherein said ink comprises from 0.01 to 2% by weight of an alginate.

8. A process according to claim 1, wherein said ink comprises from 0.01 to 2% by weight of a water-soluble, non-ionic cellulose ether.

9. A process according to claim 1, wherein said ink comprises from 5 to 30% by weight of 1,2-propylene glycol or N-methyl-2-pyrrolidone together with from 0.01 to 2% by weight of an alginate or a water-soluble, non-ionic cellulose ether.

10. A process according to claim 1, wherein said ink has a viscosity of from 1 to 40 mPa·s.

11. A process according to clairr wherein said ink further comprises a buffer substance.

12. A process according to claim 1, wherein said fibre materials are cellulosic fibre materials.

13. An aqueous printing ink for the ink-jet printing process, comprising a) from 5 to 35% by weight of at least one reactive dye of formulae (1a) to (1j) according to claim 1 and b) from 0.01 to 2% by weight of an alginate with the proviso that said ink does not contain any substantial amount of a compound of the formula $S(CH_2CH_2OH)$.

14. An aqueous printing ink for the ink-jet printing process, comprising a) from 5 to 35% by weight of at least one reactive dye of formulae (1a) to (1j) according to claim 1, b) from 0.01 to 2% by weight of an alginate or a water-soluble, non-ionic cellulose ether, and c) from 5 to 30% by weight of 1,2-propylene glycol or N-methyl-2-pyrrolidone with the proviso that said ink does not contain any substantial amount of a compound of the formula $S(CH_2CH_2OH)$.

* * * * *

UNITED STATES PATENT AND TRADEMARK OFFICE

CERTIFICATE OF CORRECTION

PATENT NO. : 6,007,611
DATED : DECEMBER 28, 1999
INVENTOR(S) : MICKAEL MHEIDLE ET AL

It is certified that error appears in the above-identified patent and that said Letters Patent is hereby corrected as shown below:

On the title page , Section [30] should read:

-- [30] Foreign Application Priority Data

| | | | |
|---|---|---|---|
| Jun 17, 1997 | [CH] | Switzerland | 1474/97 |

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,007,611
DATED : December 28, 1999
INVENTOR(S) : Mickael Mheidle et al.

It is certified that error appears in the above-identified patent and that said Letters Patent is hereby corrected as shown below:

Column 24,
Line 23, should read: -- tial amount of a compound of the formula $S(CH_2CH_2OH)_2$. --.
Line 34, should read: -- tial amount of a compound of the formula $S(CH_2CH_2OH)_2$. --.

Signed and Sealed this

Thirty-first Day of December, 2002

JAMES E. ROGAN
*Director of the United States Patent and Trademark Office*